United States Patent [19]

McMahon et al.

[11] Patent Number: 4,468,144

[45] Date of Patent: Aug. 28, 1984

[54] DETACHABLE CARRIAGE ASSEMBLY FOR PRINTER

[75] Inventors: Ronald G. McMahon; Donnie E. Hale, both of Garland, Tex.

[73] Assignee: Contitronix, Inc., Garland, Tex.

[21] Appl. No.: 386,717

[22] Filed: Jun. 9, 1982

[51] Int. Cl.³ ..... B41J 19/00

[52] U.S. Cl. ..... 400/354; 400/320; 403/13; 403/158; 384/269

[58] Field of Search ..... 308/4 R, 3.5, 3.9, DIG. 3, 308/DIG. 11; 384/265, 269, 273, 274; 74/89.2, 89.21, 89.22; 403/13; 400/320, 335, 352, 354, 354.1, 354.2, 354.3, 354.4, 355; 403/26, 158

[56] References Cited

U.S. PATENT DOCUMENTS

| | | | |
|---|---|---|---|
| 1,804,251 | 5/1931 | Dines | 384/269 |
| 2,557,259 | 6/1951 | Chason | 384/273 |
| 2,676,068 | 4/1954 | Lincke | 384/265 |
| 3,872,960 | 3/1975 | Gabor | 400/335 |
| 4,111,293 | 9/1978 | Kockler et al. | 400/320 |
| 4,114,467 | 9/1978 | Petershack | 403/158 |
| 4,189,244 | 2/1980 | Harrison | 400/320 |
| 4,200,402 | 4/1980 | Rix | 400/354.1 |
| 4,222,673 | 9/1980 | Plaza et al. | 400/352 |
| 4,225,191 | 9/1980 | Knoski | 403/13 |
| 4,277,189 | 7/1981 | Howard et al. | 400/320 |
| 4,300,847 | 11/1981 | Hoffman et al. | 400/320 |
| 4,303,347 | 12/1981 | Siegenthaler | 400/354 |

FOREIGN PATENT DOCUMENTS

| | | | |
|---|---|---|---|
| 1031009 | 5/1966 | United Kingdom | 308/3.9 |

OTHER PUBLICATIONS

Survant, "Self Adjustment . . . ", IBM Technical Disclosure Bulletin, vol. 25, No. 7A, pp. 3201–3202, 12/82.

Schall et al, "Felt Wiper Retainer", IBM Technical Disclosure Bulletin, vol. 24, No. 3, pp. 1420–1421, 8/81.

Bailey et al, "Magnetic Head . . . ", IBM Technical Disclosure Bulletin, vol. 21, No. 4, pp. 1598–1599, 9/78.

*Primary Examiner*—William Pieprz

*Attorney, Agent, or Firm*—Sigalos & Levine

[57] ABSTRACT

A detachable carriage assembly for a printer having a frame for supporting a cylindrical platen and a drive motor for moving said carriage assembly and comprising first and second parallel supports mounted in spaced apart relationship on the frame of the printer parallel to the platen, a pulley support assembly movably mounted on one of the supports and connected to the drive motor for movement parallel to the one support, a bearing assembly slidably mounted on the other of the supports and a carriage assembly detachably mounted to the pulley support assembly and the bearing assembly for moving parallel to the platen as the pulley support assembly moves.

11 Claims, 11 Drawing Figures

DETACHABLE CARRIAGE ASSEMBLY FOR PRINTER

BACKGROUND OF THE PRESENT INVENTION

The present invention relates to a carriage assembly for a printer and in particular a detachable carriage assembly which can be quickly and easily detached and replaced as necessary. It should be understood that while the invention relates to a carriage assembly for any types of a printer, it will be discussed herein in relationship to a typewriter as the particular type of printer in which the invention is used and, therefore, whenever the word typewriter is used hereinafter, it is intended to cover all types of printers.

The prior art carriage assembly for typewriters are attached to the typewriter frame in a very complicated and unwieldy manner. The carriage mechanism is integrally formed with a pulley support assembly and may include the daisy wheel or other print mechanism, the motor to drive the print mechanism, the solenoid to cause the print mechanism to engage the platen holding the paper, the ribbonholder and ribbon winding mechanism, any ribbons used for erasure, any electrical circuits for driving the electronics on the print mechanism, and other mechanical or electrical equipment. Further, since the carriage assembly usually moves on parallel horizontal shafts, bearings must be utilized on those shafts and as the bearings wear through use, and it becomes necessary to replace them, or if for any reason the carriage has to be removed, the entire carriage assembly and pulley support assembly must be removed and replaced and the cables removed and the procedure by which this is accomplished is very time consuming and complex. In such cases, the cable tension must be readjusted. In other cases, the shaft or shafts on which the pulley support assembly and combined carriage assembly ride must be removed entirely in order to remove the carriage assembly. This is also a complex and time consuming procedure.

The present invention overcomes the disadvantages and complexities of the prior art by providing a carriage assembly having all the elements thereon as described above and yet which is detachably mounted on a pulley support assembly movably coupled to one of two spaced supports and slidably attached to a bearing assembly slidably mounted on the other of said spaced supports. Thus simply by removing two screws which hold the carriage assembly to the pulley support assembly, the carriage assembly may be lifted off the pulley support assembly and slidably removed from the bearing assembly on the other parallel support, the electrical cable disconnected and the entire unit removed and replaced in like manner in simply a matter of minutes.

Further, the pulley support assembly on which the carriage assembly rides has an adjustable bearing by which it is mounted on the first parallel support whereby, as wear occurs, the bearing can be adjusted and tightened without having to remove the pulley support assembly.

Further, the pulley support assembly has its own cable drive system which moves the pulley support assembly in a horizontal plane parallel to the cylindrical platen thereby carrying the carriage assembly in proximate spaced relationship to the platen for typing purposes. The pulley support assembly has its own cable tension adjusting means attached to the cable which can be adjusted separately to maintain the proper tension on the cable for proper carriage movement.

Further, inasmuch as the pulley support assembly is carrying the detachable carriage assembly, it is desirable and necessary that means be provided for adjusting the relative position of the carriage assembly with respect to the cylindrical platen. Normally this is done by adjusting the cylindrical platen in both vertical and horizontal planes. In the present invention, it is accomplished by a simple adjustment of the parallel support carrying the pulley support assembly whereby the parallel support is adjusted in a horizontal plane by a simple movement thus enabling the carriage assembly riding upon the pulley support assembly to also be moved in relationship to the cylindrical platen.

SUMMARY OF THE INVENTION

Thus the present invention relates to a detachable carriage assembly for a printer having a frame for supporting a cylindrical platen and a drive motor for moving said carriage assembly and comprising first and second parallel supports mounted in spaced apart relationship on the frame of said printer parallel to said platen, a pulley support assembly movably mounted on one of said supports and connected to said drive motor for movement parallel to said one support, a bearing assembly slidably mounted on the other of said supports and a carriage assembly detachably mounted to said pulley support assembly and said bearing assembly for moving parallel to said platen as said pulley support assembly moves.

BRIEF DESCRIPTION OF THE DRAWINGS

These and other objects of the present invention will be disclosed in the course of the following specification, reference being had to the accompanying drawings in which.

DETAILED DESCRIPTION OF THE PREFERRED EMBODIMENT

Figure 1:
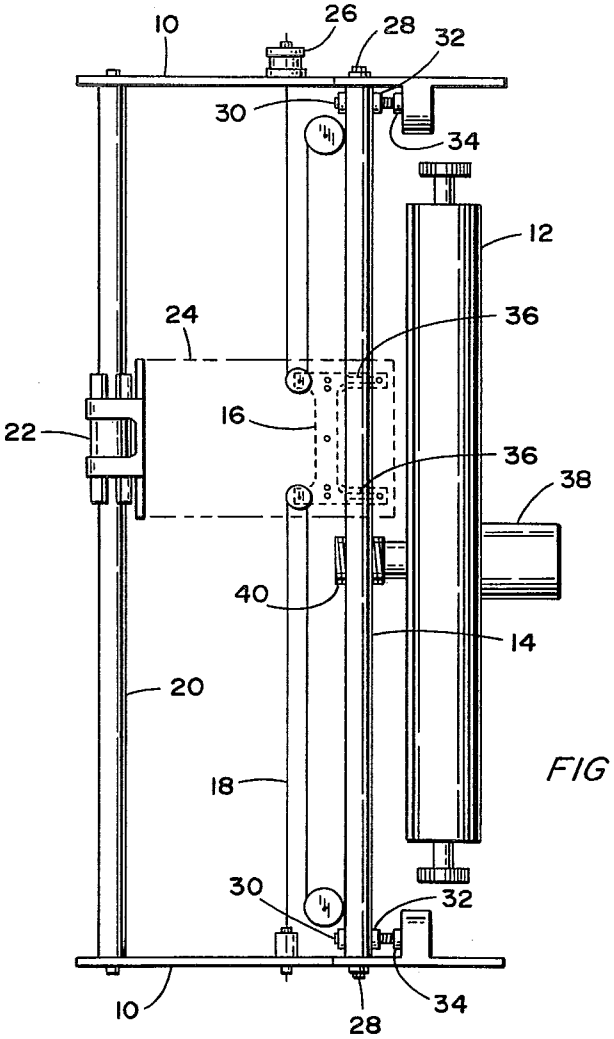
FIG. 1 is a partial schematic view of a printer such as a typewriter illustrating one parallel support with the pulley support assembly mounted thereon and driven by a cable system and the other parallel support on which is located a bearing so that the carriage assembly can be mounted between the bearing and the pulley support assembly in an adjustable relationship to the cylindrical platen.

FIG. 1 is a schematic representation of a partial view of a printer such as a typewriter having a frame 10 to which is attached in a well known manner a cylindrical platen 12 against which the paper rests and the typing or printing occurs. Further, a first cylindrical support member 14 carries a pulley support assembly 16 which can be moved in a horizontal plane parallel to said cylindrical platen 12 by a cable assembly 18. A second parallel cylindrical support member 20 is mounted to frame 10 in spaced apart relationship to the first cylindrical support member 14. A bearing assembly 22 rides on second support member 20 and a detachable carriage assembly 24 rests on and is attached to pulley support assembly 16 and said bearing assembly 22. A cable tension adjusting means 26 is attached to said cable system 18 and is mounted on frame 10 of the printer for adjusting the tension of cable system 18. Further, front cylindrical support member 14 is adjustable in a horizontal plane to correctly position detachable carriage assembly 24 with respect to cylindrical platen 12. Front cylindrical support member 14 is attached to frame 10 by means of bolts 28 on each end thereof. In addition, a further bolt 30 is mounted near each end of the front parallel support 14 in a direction perpendicular to the axis of said support 14 and is attached to frame 10 and held in place by first and second nuts 32 and 34. If it is desired to adjust the horizontal position of front support 14 with respect to cylindrical platen 12, it is only necessary to loosen the end bolts 28, loosen nuts 32 and 34, and then adjust bolts 30 so that front support 14 moves towards or away from platen 12 and when the correct spacing has been attained, the nuts 32 and 34 are tightened again and end nuts 28 are tightened thus properly positioning front support 14. It will be noted that pulley support assembly 16 is fastened to front support 14 by means of bearing supports 36 and thus when the front support 14 is adjusted with respect to platen 12, pulley support assembly 16 also moves with respect to platen 12. Because the detachable carriage assembly 24 is mounted on pulley support assembly 16 and because the carriage assembly 24 is slidably mounted on bearing assembly 22, the entire carriage assembly 24 is moved towards or away from cylindrical platen 12 with the simple adjustment of front support 14 in the horizontal plane as just described. Further, motor 38 drives a drum assembly 40 on which cable 18 is wrapped and thus when motor 38 turns drum assembly 40, the entire cable assembly causes pulley support assembly 16 to move parallel to cylindrical platen 12 thus causing detachable carriage assembly 24 to also move parallel to cylindrical platen 12 so that printing can take place.

Figure 2:
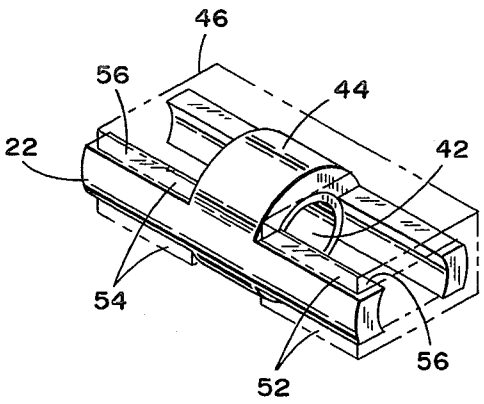
FIG. 2 is an isometric view of the bearing assembly slidably mounted on the other one of the supports and on which one end of the carriage assembly rests.

FIG. 2 is an isometric view of the bearing support assembly 22 which rides on rear support 20 and which slidably receives the detachable carriage assembly 24. The assembly comprises a bearing 42 which can be slidably mounted on rear support 20 and a cylindrical cover 44 slidably mounted over and being longer than said cylindrical bearing 42. Means are provided on cylindrical cover 44 for slidably receiving a U-shaped bracket 46 shown in dashed lines in FIG. 2 and which U-shaped member is attached to the carriage assembly 24 shown in FIG. 1.

Figure 3:
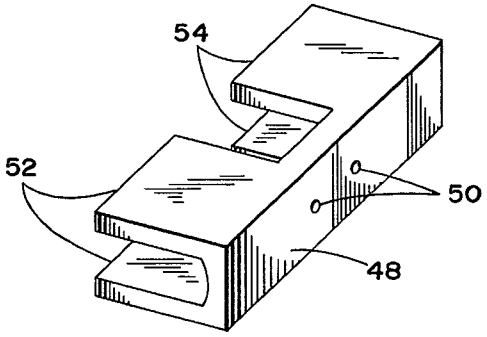
FIG. 3 is an isometric view of the carriage assembly U-shaped mount which attaches slidably to the bearing assembly shown in FIG. 2.

As will be seen in FIG. 3, U-shaped bracket 46 includes a base 48 having orifices 50 therein by which the base can be attached to carriage assembly 24. Also, base 48 has a first pair of arms 52 forming a U shape and a second pair of arms 54 extending therefrom also which forms a U shape. As can be seen in FIG. 2 by the dotted lines, shoulders 56 are formed on the outer portion of each end of bearing cover 44 which shoulders extend outwardly beyond the bearing 42. The shoulders are formed by removing an arcuate section of the cover 44 on each end thereof to expose an end of bearing 42 and support 20 on which it rides whereby the U-shaped bracket arm pairs 52 and 54 slidably engage the shoulder on each end of said cover to contact and contain bearing 42 within cover 44. If the bearing is press fit, this would not be necessary. Further, because the bracket arm pairs 52 and 54 are slidably engaged with the shoulders of bearing cover 44, any movement of the carriage assembly 24 to which the bracket base 48 is attached simply causes the bracket to slidably move towards or away from bearing outer cover 46 and thus allows adjustment of carriage assembly 24 to take place.

Figure 4:
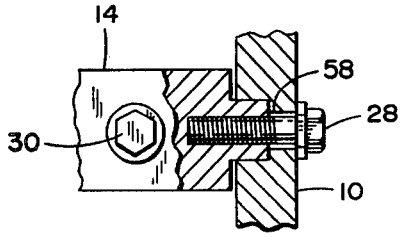
FIG. 4 is a partial cross sectional view of the printer frame and front support on which the pulley support assembly rides and which illustrates the manner in which the front support is attached to the printer frame.

FIG. 4 is a partial cross sectional view of the frame 10 and one end of front cylindrical support shaft 14 illustrating the manner in which it is attached to frame 10. Thus, bolt 28 passes through a slot 58 into front support 14. By tightening bolt 28, front support 14 is pulled tightly against frame 10 and held securely in place. When it is desired to adjust the position of front support 14 in a horizontal plane, bolt 28 is loosened on each end of front support 14 and then bolt 30 is adjusted at each end to allow front support 14 to move horizontally in slot 58.

Figure 5:
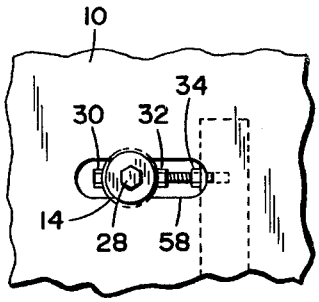
FIG. 5 is an end view of the printer frame illustrating the manner in which the front support assembly is not only fastened to the printer frame at the end thereof but also illustrating the manner in which the front support assembly can be adjusted in a horizontal plane so that the print mechanism can be adjusted with respect to the cylindrical platen.

This can be more clearly seen in FIG. 5 wherein slot 58 is shown in frame 10 and bolt 28 is extending into the end of front cylindrical support 14 to hold the front support 14 snugly against frame 10. Also passing through and near one end of front support 14 in a direction perpendicular to the longitudinal axis of front support 14 is bolt 30. The end of bolt 30 is mounted in a part of an extension of frame 10 and has bolts 32 and 34 tightened to hold the front support 14 tightly in place. If it is desired to position front support 14 with respect to cylindrical platen 12, bolt 28 is loosened and nuts 32 and 34 are loosened and then bolt 30 is either tightened or loosened to move front support 14 either towards or away from cylindrical platen 12. When that adjustment has been completed on both ends of support 14 and front support 14 is properly positioned with respect to cylindrical platen 12, nuts 32 and 34 are then tightened and bolt 28 is tightened and the front support 14 is held tightly in place.

Figure 6:
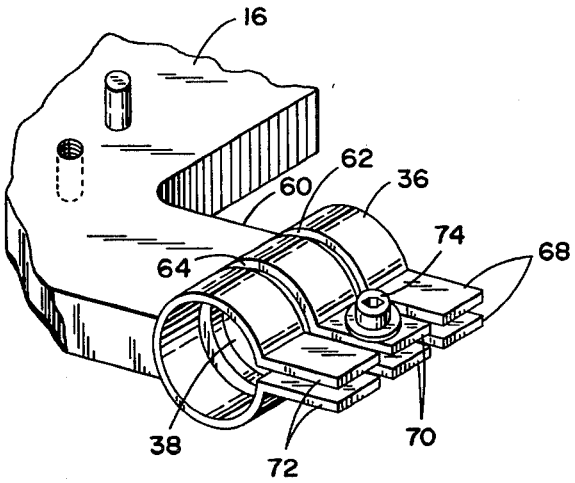
FIG. 6 is a partial isometric view of the pulley support assembly illustrating one of the bearing supports and its construction.

FIG. 6 is a partial view of the pulley support assembly 16 illustrating one of the bearing support assemblies 36 thereon. An arm 60 forms a part of pulley support assembly 16 and has a cylindrical bearing mount 36 in which a C-shaped split bearing 38 is slidably mounted.

Figure 7:
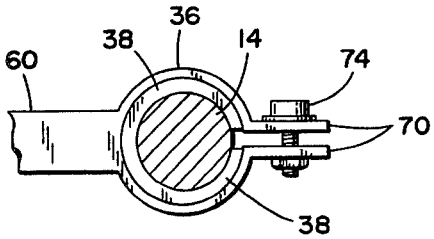
FIG. 7 is an end view of the bearing support shown in FIG. 6.
Figure 8:
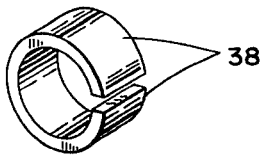
FIG. 8 illustrates the type of split, C-shaped bearings utilized in the assembly of FIG. 6 which can be adjusted to accommodate bearing wear.
Figure 9:
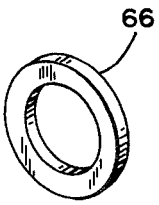
FIG. 9 is an isometric view of a washer assembly utilized in the bearing of FIG. 6 to prevent the bearing from slipping from its assigned position.

Said cylindrical housing 36 is also C-shaped and includes first and second slits 62 and 64 extending through said C-shaped housing 36 at corresponding ends of said C-shaped slit bearing 38. Washers 66, such as that shown in FIG. 9, are inserted in slits 62 and 64 about said front support 14 to confine said C-shaped split bearing 38 between said washers 66. Horizontal extensions 68, 70 and 72 are formed on the open ends of said C-shaped housing 36 enclosing said bearing 38 and bolt 74 is mounted in an orifice in said horizontal extensions 70 whereby when said bolt is tightened extensions 70 are forced together thereby tightening said C-shaped split bearing 38 on said front support 14. Thus the bearing pressure is adjustable by adjusting the pressure on horizontal extension 70 by turning bolt 74. C-shaped split bearings 38 are shown in FIG. 8 and are mounted about front support 14 as illustrated in FIG. 7. Thus it can be seen in FIG. 7 that C-shaped split bearing 38 is mounted on and about front support 14 but rests inside of C-shaped housing 36 which is attached to the end of arm 60 on carriage assembly 16. By adjusting the tension on horizontal extensions 70, by means of tightening bolt 74, the bearing pressure on front support 14 can be adjusted as desired. Thus as the bearings 38 wear, it is not necessary to replace the entire mechanism but simply to adjust the pressure on the bearings 38 by means of bolt 74.

Figure 10:
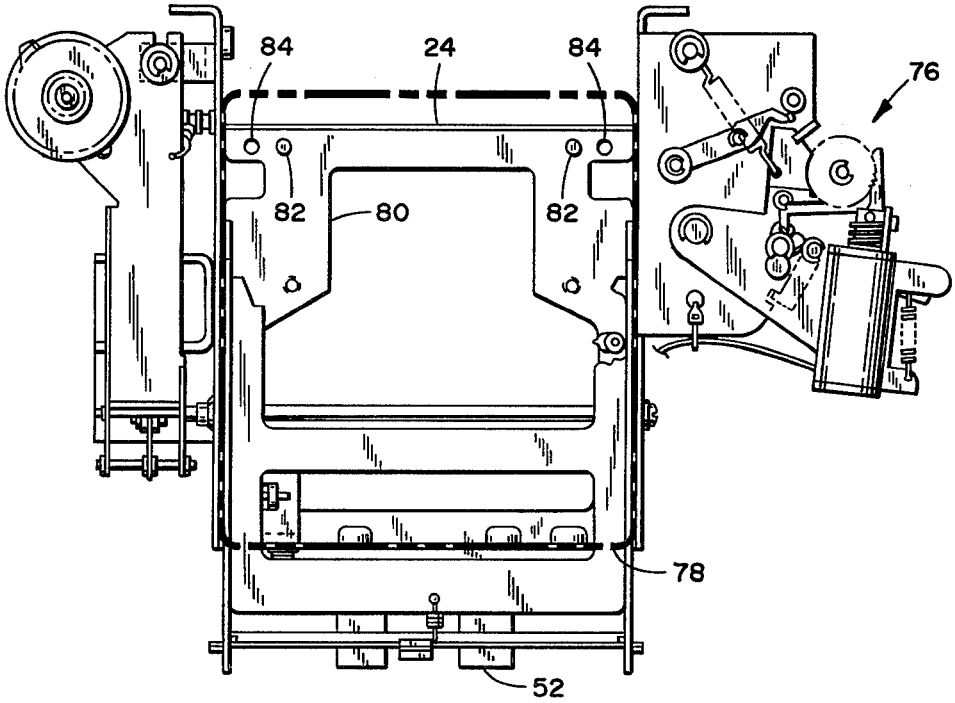
FIG. 10 is a partial schematic representation of the detachable carriage assembly which is carried by the pulley support assembly and the rear bearing support.
Figure 11:
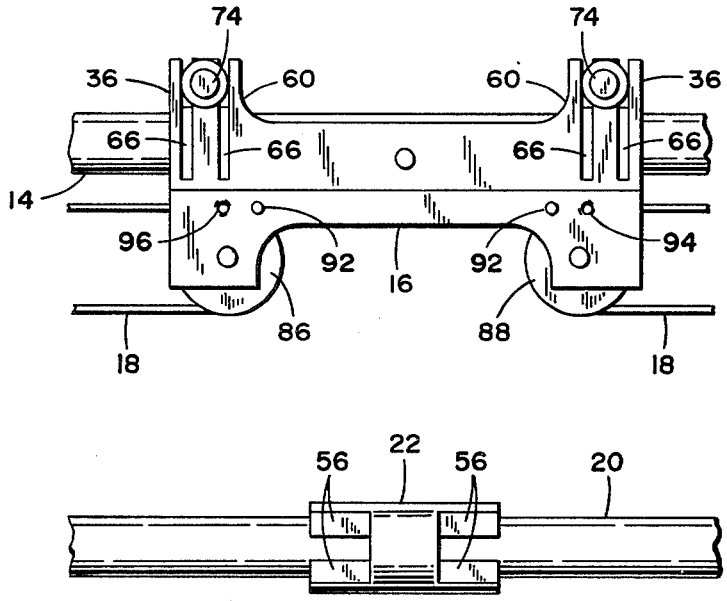
FIG. 11 is a top view of the pulley support assembly mounted on the front cylindrical support and which carries the detachable carriage assembly.

FIG. 10 is a schematic representation of the basic detachable carriage assembly 24 without the print mechanism, the print mechanism drive motor and the like but is illustrated to show the manner in which it is attached to the pulley assembly. The frame of carriage assembly 24 may have thereon the erase or correction ribbon movement assembly 76 and the print ribbon mechanism 78. The front end portion of carriage assembly 24 has a plate 80 in which are located a pair of orifices 82 for receiving guide pins on the pulley support assembly as shown in FIG. 11. Further, it has a pair of orifices 84 for receiving bolts which pass therethrough and engage mating threaded orifices on the pulley support assembly as shown in FIG. 11. Also shown in FIG. 10 and mounted on the back portion of detachable carriage assembly 24 is the U-shaped bracket 46 shown in FIG. 3 having pairs of arms 52 and 54 which engage bearing assembly 22 shown in FIG. 1. As indicated earlier, other components may be mounted on detachable carriage assembly 24 but are not shown in FIG. 10 for purposes of clarity.

FIG. 11 is a partial schematic view of the printer itself illustrating the pulley support assembly 16 mounted on front support 14 and bearing assembly 22 mounted on rear support 20. As can be seen in FIG. 11, pulley support assembly 16 is mounted on front support 14 by means of C-shaped housing 36 which has C-shaped split bearings inside thereof (shown more clearly in FIGS. 6, 7, 8, and 9) and an adjustment bolt 74 in each of arms 60 for adjusting the tension of the C-shaped split bearings contained in said C-shaped housing 36. In addition, cable system 18 is coupled to a drive mechanism, not shown, which causes the entire assembly to move by means of pulleys 86 and 88. In order for the detachable carriage assembly 24 to quickly be attached to or removed from pulley support assembly 16, guide pins 90 and 92 are provided thereon for mating with matching orifices 82 on the detachable carriage assembly 24 as shown in FIG. 10. In addition, threaded orifices 94 and 96 receive the bolts extending through mating orifices 84 shown in FIG. 10 in order to attach the detachable carriage assembly 24 to the carriage assembly 16. Also, bearing assembly 22 has shoulders 56 which slidably receive the arms 52 and 54 of the U-shaped bracket shown in FIG. 2 and FIG. 3.

Thus there has been disclosed a novel detachable carriage assembly for a printer such as a typewriter which can be quickly and easily removed and replaced as desired in a simple manner and without requiring a great deal of time or training. In addition, the detachable carriage assembly 24 is so attached to the printer that it can be adjusted easily in a horizontal plane with respect to the cylindrical platen so that the printing elements can be adjusted properly in a very simple manner without removing the carriage assembly 24 itself.

While the invention has been described in connection with a preferred embodiment, it is not intended to limit the scope of the invention to the particular form set forth but, on the contrary, it is intended to cover such alternatives, modifications, and equivalents as may be included in the spirit and scope of the invention as defined by the appended claims.

We claim:

1. A detachable carriage assembly for a printer having a frame for supporting a cylindrical platen and a drive motor for moving said carriage assembly, said carriage assembly having a print mechanism thereon, and comprising:

a. first and second parallel supports mounted in spaced apart relationship on the frame of said printer parallel to said platen, b. a pulley support assembly movably mounted on only one of said supports and pulleys connected by flexible motion transmitting means to said drive motor for horizontal movement of said support assembly parallel to said supports, c. a bearing assembly slidably mounted on the other of said supports independent of and spaced from said pulley support assembly, and d. said carriage assembly being coupled between said pulley support assembly and said bearing assembly, said carriage assembly being detachably secured to said pulley support assembly and slidably engaging said bearing assembly for moving said carriage assembly horizontally and parallel to said platen as said pulley support assembly moves thereby moving said printer mechanism in a direction parallel to said platen whereby said carriage assembly may be removed from said printer and replaced without adjustments to said pulley support assembly.

2. A detachable carriage assembly as in claim 1 further including:

a. alignment pins on said pulley support assembly and corresponding mating orifices on said carriage assembly for properly aligning said carriage assembly on said pulley support assembly, b. means on said pulley support assembly and corresponding mating means on said carriage assembly for attaching said print mechanism to said carriage assembly in said proper alignment, and c. a U-shaped bracket attached to said carriage assembly for slidably engaging said bearing assembly in a locking relationship whereby horizontal movement of said carriage assembly in a direction parallel to said parallel supports moves said bearing assembly parallel to said platen.

3. A detachable carriage assembly as in claim 2 wherein said slidable bearing assembly comprises:

a. a cylindrical bearing slidably mounted on said other support, b. a cylindrical cover slidably mounted over and being longer than said cylindrical bearing, and c. means on said cylindrical cover for slidably receiving said U-shaped bracket on said carriage assembly for holding said bearing in said bearing cover and simultaneously allowing said carriage assembly to be adjusted in a horizontal plane perpendicular to said other support.

4. A detachable carriage assembly as in claim 3 wherein said means on said cylindrical cover for receiving said U-shaped bracket comprises:

a. a shoulder on the outer portion of each end of said cover extending outwardly beyond said bearing, and b. said shoulder on each end of said cover being formed by removing an arcuate section of said cover to expose an end of said bearing and said other support whereby said U-shaped bracket on said carriage assembly slidably engages said one shoulder on each end of said cover to contact and contain said bearing within said cover.

5. A detachable carriage assembly as in claim 4 further including an adjustable bearing coupling said pulley support assembly to said one support whereby wear of said bearing may be compensated.

6. A detachable carriage assembly as in claim 5 wherein said adjustable bearing comprises:

a. a C-shaped split bearing slidably mounted on said one support, b. at least one bearing mount coupling said pulley support assembly to said bearing on said one support, said bearing mount forming a part of said pulley support assembly and comprising a C-shaped housing enclosing said split bearing, c. means for containing said split bearing in said bearing mount, and d. means on said bearing mount for adjusting the fit of said split bearing about said one support.

7. A detachable carriage assembly as in claim 6 wherein said means for containing said split bearing in said bearing mount comprises:

a. first and second splits extending through said C-shaped housing at corresponding ends of said bearing, and b. washers inserted in said slits about said one support to confine said bearing between said washers.

8. A detachable carriage assembly as in claim 7 wherein said means on said bearing mount for adjusting said split bearing comprises:

a. horizontal extensions on the open end of said C-shaped housing enclosing said bearing, and b. means for applying pressure to said horizontal extensions in a direction to force said extensions together thereby tightening said split bearing about said one support.

9. A detachable carriage assembly as in claim 8 wherein said means for applying pressure to said horizontal extensions is a bolt extending through said extensions for bringing one extension closer to the other as said bolt is turned.

10. A detachable carriage assembly as in claim 1 wherein said one of said parallel supports is adjustable in a horizontal plane to correctly position said print mechanism with respect to said cylindrical platen.

11. A detachable carriage assembly as in claim 1 further including:

a. cable drive means attached to said drive motor and said pulley support assembly whereby said pulley support assembly may be moved parallel to said platen while carrying said carriage assembly, and b. a cable tension adjusting means attached to said cable for adjusting the tension thereof.

* * * * *